US005182044A

United States Patent [19]

Yanaba et al.

[11] Patent Number: 5,182,044

[45] Date of Patent: Jan. 26, 1993

[54] ZEOLITE CONTAINING LIQUID DETERGENT COMPOSITION

[75] Inventors: Shigeru Yanaba; Masataka Shiobara; Koji Masamizu; Kiyoshi Morohara; Seiji Abe, all of Tokyo, Japan

[73] Assignee: Lion Corporation, Tokyo, Japan

[21] Appl. No.: 638,963

[22] Filed: Jan. 9, 1991

[30] Foreign Application Priority Data

Jun. 1, 1990 [JP] Japan ..... 2-143472

[51] Int. Cl.[5] ..... C11D 3/12; C11D 3/20; C11D 3/37; C11D 3/26

[52] U.S. Cl. ..... 252/174.24; 252/174.25; 252/548; 252/558; 252/DIG. 2; 252/DIG. 14

[58] Field of Search ..... 252/174.24, 135, DIG. 2, 252/DIG. 14, 174.25, 558, 548

[56] References Cited

U.S. PATENT DOCUMENTS

| | | | |
|---|---|---|---|
| 3,632,420 | 1/1972 | Kuhn | 252/8.8 R |
| 3,723,358 | 3/1973 | Morgan et al. | 252/174.24 |
| 4,002,571 | 1/1977 | Anderle et al. | 252/174.24 |
| 4,038,027 | 7/1977 | Kearney | 8/115.7 |
| 4,230,605 | 10/1980 | Connolly et al. | 252/174.24 |
| 4,233,167 | 11/1980 | Sramek | 252/173 |
| 4,647,396 | 3/1987 | Denzinger et al. | 252/174.24 |
| 4,725,319 | 2/9188 | Osberghaus | 252/174.24 |
| 4,978,770 | 12/1990 | Aoyagi et al. | 252/102 |
| 5,004,557 | 4/1991 | Nagarajarr et al. | 252/174.24 |

FOREIGN PATENT DOCUMENTS

| | | |
|---|---|---|
| 0130639 | 1/1985 | European Pat. Off. . |
| 0213500 | 3/1987 | European Pat. Off. . |
| 0245987 | 11/1987 | European Pat. Off. . |
| 0295093 | 12/1988 | European Pat. Off. . |
| 55-7806 | 1/1980 | Japan . |
| 3-109500 | 5/1991 | Japan . |
| 1190023 | 4/1970 | United Kingdom . |
| 1528592 | 10/1978 | United Kingdom . |
| 2053880A | 2/1981 | United Kingdom . |

*Primary Examiner*—Paul Lieberman
*Assistant Examiner*—Erin Higgins
*Attorney, Agent, or Firm*—Armstrong, Westerman, Hattori, McLeland, & Naughton

[57] ABSTRACT

A liquid detergent composition comprising:

(a) 5 to 50% by weight of a surfactant;

(b) 1 to 30% by weight of a zeolite; and (c) 0.1 to 5% by weight of (i) a copolymer containing copolymerized components having the formulae (I) and (II) and a weight average molecular weight of 100,000 or more; or (ii) a copolymer containing the copolymerized components having the formulae (III), (IV), and (V):

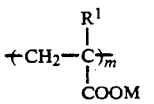

(I)

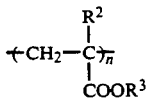

(II)

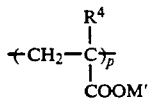

(III)

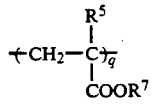

(IV)

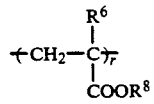

(V)

wherein $R^1$ represents hydrogen or methyl, $R^2$ represents hydrogen or methyl, $R^3$ represents an alkyl group having 1 to 6 carbon atoms, $R^4$ represents hydrogen or methyl, $R^5$ represents hydrogen or methyl, $R^6$ represents hydrogen or methyl, $R^7$ represents methyl or ethyl, $R^8$ represents an alkyl or alkenyl having 3 to 24 carbon atoms, M and M' represents hydrogen or a counter ion, and m/n is 2/8 to 7/3 (mol ratio).

p/q is 2/8 to 8/2 (mol ratio) and $r/(p+q+r)=1/50$ to 20/50 (mol ratio).

5 Claims, No Drawings

ZEOLITE CONTAINING LIQUID DETERGENT COMPOSITION

BACKGROUND OF THE INVENTION

1. Field of the Invention

The present invention relates to a liquid detergent composition containing a zeolite builder stably dispersed therein.

2. Description of the Related Art

In the prior art, liquid detergents and powder detergents are employed as the detergent for clothing. Liquid detergents have excellent properties such that they can be easily measured during usage, they can be directly coated on contaminated portions of clothing for washing, and that they will not "fly up" like powder detergents and cause problems such as choking, etc.

On the other hand, liquid detergents have a problem in that the system is liable to become nonuniform because of the occurrence of phase separation, etc.

For example, when a strong electrolyte such as sodium carbonate or sodium silicate is added as an alkali builder, a liquid detergent, different from a granular detergent, will suffer from separation of the surfactant by a salting out from the system, and to prevent this, an organic alkali such as alkaolamine is primarily employed.

In granular detergents, as the Ca ion capturing builder, zeolites are now used to solve the problem of a eutrophication of phosphates in closed water regions, but such zeolites are water-insoluble solids and will be sedimented when added to liquid detergents, and thus are difficult to formulate into a stable dispersion.

Further, as the Ca ion capturing builder, organic builders such as acrylic acid derivatives or citric acid can be used, but when added to liquid detergents in an amount required to exhibit a sufficient effect, problems arise such that the viscosity of the system is increased and that the system suffers from phase separation.

Nevertheless, to obtain a strong washing power, a Ca ion capturing builder must be added, and accordingly, attempts have been made to stably disperse zeolites, which are also lower in cost, into a liquid. For example, in Japanese Unexamined Patent Publication (Kokai) No. 58-145794, it is intended to form liquid crystals by an addition of an electrolyte to an aqueous surfactant solution, to thereby stabilize the dispersion of solid particles such as zeolite, etc. But in such a dispersion system, because the surfactant is salted out, the viscosity of the system will become markedly higher, and thus the useability thereof is poor.

SUMMARY OF THE INVENTION

The objects of the present invention are to eliminate the above-mentioned disadvantages of the prior art and to provide a stable liquid detergent composition which exhibits a strong washing power when containing a zeolite but does not suffer from a phase separation of the system even when stored at high temperatures for a long term.

Other objects and advantages of the present invention will be apparent from the description set forth hereinbelow.

In accordance with the present invention, there is provided a detergent composition comprising:

(a) 5 to 50% by weight of a surfactant;

(b) 1 to 30% by weight of a zeolite and (c) 0.5 to 5% by weight of a copolymer containing copolymerized components having the formulae (I) and (II) and a weight average molecular weight of 100,000 or more:

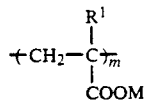

(I)

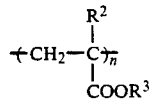

(II)

wherein $R^1$ represents hydrogen or methyl, $R^2$ represents hydrogen or methyl, $R^3$ represents an alkyl group having 1 to 6 carbon atoms, M represents hydrogen or a counter ion, and m/n is 2/8 to 7/3 (mol ratio).

In accordance with the present invention, there is also provided a detergent composition comprising:

(a) 5 to 50% by weight of a surfactant;

(b) 1 to 30% by weight of a zeolite; and (c) 0.1 to 5% by weight of a copolymer containing the copolymerized components having the formulae (III), (IV), and (V):

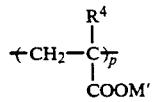

(III)

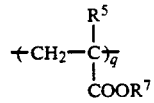

(IV)

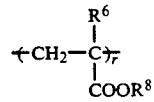

(V)

wherein $R^4$ represents hydrogen or methyl, $R^5$ represents hydrogen or methyl, $R^6$ represents hydrogen or methyl, $R^7$ represents methyl or ethyl, $R^8$ represents an alkyl or alkenyl having 3 to 24 carbon atoms, M' represents hydrogen or a counter ion, p/q is 2/8 to 8/2 (mol ratio) and $r/(p+q+r)=1/50$ to 20/50 (mol ratio).

DESCRIPTION OF THE PREFERRED EMBODIMENTS

The surfactants usable in the present invention include, for example, the below-mentioned anionic or nonionic surfactants. As the salts of the anionic surfactants, for example, sodium salt, potassium salt, and alkanol amine salt may be used.

ANIONIC SURFACTANT

1) Straight alkylbenzene sulfonates having alkyl groups with 8 to 16 carbon atoms;

2) Alkylsulfates with 10 to 20 carbon atoms;

3) Olefinsulfonates with 10 to 20 carbon atoms;
4) Alkanesulfonates with 10 to 20 carbon atoms;
5) Alkyl ether sulfates or alkenyl ether sulfates having straight or branched alkyl groups with carbon atoms of 10 to 20 and having 0.5 to 8 moles, on average, of ethylene oxide added thereto;

NONIONIC SURFACTANT

Ethyleneoxide (EO)-addition type nonionic surfactants of primary or secondary alcohols having 8 to 18 carbon atoms and having 7 to 18 moles, on average, of ethylene oxide added thereto.

The surfactant (a) is preferably formulated at a proportion of 5 to 50% by weight, more preferably 15 to 30% by weight. When the amount formulated is less than 5% by weight, a sufficient detergent force cannot be obtained, and if it exceeds 50% by weight, the liquid properties will be unstable.

In the liquid detergent composition of the present invention, in addition to the anionic or nonionic surfactant (a), other surfactants, i.e., amphoteric surfactants, semi-polar surfactants, and cationic surfactants, can be also used in combination therewith. In this case, it is not desirable to formulate other surfactants at a weight ratio of 1:3 or more of the (anionic or nonionic surfactant):(other surfactants).

As the zeolite (b), those having the following formula (VI) may be used.

$$x(M''_2O \text{ or } M'''O).Al_2O_3.y(SiO_2).z(H_2O) \quad \text{(VI)}$$

wherein M'' represent an alkali metal atom, M''' represents an alkaline earth metal atom exchangeable with calcium, x, y and z are a mole number of each component, and preferably, x is 0.7–1.5, preferably $y=1$–3, and z is an optional number.

The zeolite (b) is preferably formulated at a proportion of 1 to 30% by weight, more preferably 5 to 25% by weight. When the amount formulated is less than 1% by weight, sufficient washing power cannot be obtained, and when more than 30% by weight, the viscosity of the composition will become undesirably high.

The copolymers usable in the first embodiment of the present invention are those of (meth)acrylic acid (I)/alkyl (meth)acrylate (ester) (II) or the salts of these copolymers having a mole ratio of the copolymerization of (I)/(II) of 2/8–7/3, preferably 3/7–5/5 and having a weight-average molecular weight of 100,000 or more, preferably 300,000 or more. When the copolymerization ratio or the average molecular weight is outside the above-mentioned ranges, the desired improvement of the stable dispersibility cannot be obtained. As the salts, alkali metal salts, alkanol amine salt and the like may be used.

The copolymer component (c) usable in the second embodiment of the present invention contains, as mentioned above, as the copolymer components, (meth)acrylic acid or its salt represented by the formula (III), methyl or ethyl (meth)acrylate represented by the formula (IV), and a $C_{3-24}$ alkyl or alkenyl (meth)acrylate represented by the formula (V).

Examples of the salt of M' in the (meth)acrylic acid salt are alkali metal salts such as of Na, K, Li, alkaline earth metal salts such as of Mg, Ca, ammonium salts, alkanolamine salts such as of monoethanolamine, diethanolamine, triethanolamine.

Examples of $R^8$ in the $C_{3-24}$ alkyl or alkenyl (meth)acrylate are n-propyl, i-propyl, n-butyl, i-butyl, t-butyl, 2-ethylhexyl, lauryl, myristyl, palmityl, stearyl, aralkyl, behenyl, lignoceryl or cyclohexyl groups. Note, these are commercially available under the trade names of, for example, Dobanox, Diadol, Dobanol, Neodol, and Tergitol, and further $R^8$ also can be introduced by esterification with a synthetic alcohol having a branched alkyl group.

The copolymerization ratio of the three copolymer components in the copolymer (c) according to the second embodiment of the present invention is as follows, and outside of this range, the dispersion stability of the zeolite cannot be sufficiently improved:

$$p/q=2/8 \text{ to } 8/2$$

$$r/(p+q+r)=1/50 \text{ to } 20/50.$$

The molecular weight of the copolymer (c) as a weight average molecular weight is preferably 100,000 or more, more preferably 300,000 or more, from the standpoint of an improvement of the dispersion stability.

The copolymer (c) according to the second embodiment must comprise the three copolymer components as described above (called a ternary copolymer), but provided that the ternary copolymer exists in the structural units, the copolymer component also can be increased to make a four-component copolymer or five-component copolymer. Examples of such copolymer components are N-pyrrolidone, acrylamide, hydroxyethyl acrylate and methacrylate, polyethylene glycol monoacrylate and monomethacrylate, polypropylene glycol monoacrylate and monomethacrylate, etc., acrylonitrile, styrene, vinyl acetate, dimethylaminoethyl acrylamide and methacrylamide, glycidyl methacrylate, allylsulfonic acid, acrylamidomethylpropanesulfonic acid. These copolymer components are preferably contained at a ratio of 30% by weight in the copolymer (c).

The copolymer of the component (c) may be contained at a proportion of 0.1 to 5% by weight, preferably 0.5 to 3% by weight, in the composition. When the amount formulated is less than 0.1% by weight, the dispersion stability cannot be improved, and if formulated in excess of 5% by weight, the viscosity of the compositions becomes too high.

In accordance with the present invention, (d) an alkanolamine or (d) an alkanol amine and (e) p-toluene sulfonic acid or sulfonate (salt) can be advantageously included in the above-mentioned first and second embodiments of the present invention.

Examples of the alkanolamine (d) usable in the present invention are monoethanolamine, diethanolamine, and triethanolamine. The alkanolamine can be used in an amount of 5 to 20% by weight, based on the total amount of the composition including a balance of water. When the total amounts of the surfactant, zeolite and alkanolamine is less than 30% by weight, the detergency power is lowered. When the amount of the alkanolamine is less than 5% by weight, the desired improvement in the detergency power cannot be obtained. When the amount is more than 20% by weight, a further improvement in the detergency power cannot be obtained.

The p-toluene sulfonic acid or sulfate (salt) (e) can be formulated into the liquid detergent composition for lowering the viscosity without impairing the dispersion stability, whereby the fluidity is improved and the useability or applicability becomes good. Although the p-toluene sulfonic acid (or salt thereof) is known as hydropes, p-toluene sulfonic acid (or salt thereof) among others is uniquely effective for lowering the viscosity in the detergent composition according to the present invention.

When the amount of the copolymer component is reduced to lower the viscosity, the dispersion stability becomes poor. The p-toluene sulfonic acid (or its salt) may be formulated into the composition in an amount of 0.8% by weight or more, preferably 1 to 5% by weight based on the total weight of the composition. Examples of the salt of p-toluene sulfonic acid are alkali metal salts, and alkanolamine salts.

In the composition of the present invention, in addition to the essential components as described above, conventional components such as alkali builders, chelate builders, hydrotropes, recontamination preventives, fluorescent agents, enzymes, perfumes also can be formulated.

According to the present invention, by a formulation of a specific copolymer, zeolite can be stably dispersed in a liquid detergent composition containing an anionic surfactant over a long term, and an excellent storage stability can be obtained even when the storage environment is subjected to very high temperature conditions.

EXAMPLE

The present invention now will be further illustrated by, but is by no means limited to, the following Examples and Comparative Examples.

The evaluation methods used in the Examples are as follows.

(1) Viscosity Determination Method

The viscosity of each zeolite-containing liquid detergent composition was determined at 25° C. by a BH-type viscometer (20 rpm). A viscosity of 50P or less was allowable.

(2) Storage Stability Evaluation Method

About 70 ml of each composition is placed in a polystyrene vessel of 100 cc, allowed to stand at 25° C. or 45° C. for 4 weeks, and evaluated according to the following standards Standards:

++ . . . 5 vol% or less separation ratio at upper layer

+ . . . 5 to 10 vol% separation ratio at upper layer

− . . . greater than 10 vol% separation ratio at upper layer

EXAMPLE 1

The liquid detergent compositions having compositions shown in Table 1 were prepared and evaluated. The results are shown in Table 1.

TABLE 1

| | | Sample No. | | | | | | | | | | | | |
|---|---|---|---|---|---|---|---|---|---|---|---|---|---|---|
| | | 1* | 2 | 3* | 4 | 5 | 6* | 7* | 8 | 9 | 10 | 11 | 12 | 13 |
| Composition wt % | | | | | | | | | | | | | | |
| (a) | AES*1 | 10 | 10 | 10 | 10 | 10 | 10 | 10 | 10 | 5 | 10 | 10 | 10 | 10 |
| | AOS*2 | 10 | 10 | 10 | 10 | — | — | — | — | — | 10 | 10 | 10 | 10 |
| | LAS*3 | — | — | — | — | — | — | — | — | 5 | — | — | — | — |
| | ACL*4 | — | — | — | — | 15 | 15 | 15 | 15 | — | — | — | — | — |
| (b) | Zeolite | 15 | 15 | 15 | 15 | 5 | 5 | 5 | 5 | 25 | 10 | 15 | 15 | 15 |
| (c) | Kind*5 | | | | | | | | | | | | | |
| Copolymer | $R^1$ | $CH_3$ | $CH_3$ | $CH_3$ | $CH_3$ | $CH_3$ | $CH_3$ | $CH_3$ | $CH_3$ | $CH_3$ | $CH_3$ | H | $CH_3$ | $CH_3$ |
| | $R^2$ | H | H | H | H | H | H | H | H | H | H | $CH_3$ | $CH_3$ | H |
| | $R^3$ | $C_2H_5$ | $C_2H_5$ | $C_2H_5$ | $C_2H_5$ | $C_2H_5$ | $C_2H_5$ | $C_2H_5$ | $C_2H_5$ | $C_2H_5$ | $C_2H_5$ | $C_3H_7$ | $CH_3$ | $C_4H_9$ |
| | M | DEA | DEA | DEA | DEA | MEA | MEA | MEA | MEA | MEA | TEA | TEA | Na | Na |
| | Molecular weight | $70 \times 10^4$ | | $5 \times 40^4$ | $20 \times 10^4$ | | | $70 \times 10^4$ | | | $30 \times 10^4$ | | $50 \times 10^4$ | $70 \times 10^4$ |
| | m/m ratio (Mol ratio) | | | 3/7 | | 3/7 | | 1/9 | 5/5 | 4/6 | 3/7 | | 4/6 | 5/5 |
| | Addition amount | 0.3 | 1 | 4 | 2 | 2 | 2 | 5 | 4 | 4 | 1 | 1 | 3 | 1 |
| Water | | | | | | | | Balance | | | | | | |
| Viscosity (25° C.) | | 6 | 17 | 6 | 14 | 10 | 1 | 3 | 4 | 40 | 12 | 15 | 20 | 18 |
| Storage stability | | − | ++ | − | ++ | + | − | − | + | ++ | + | ++ | ++ | ++ |

*Comparative Examples (the other samples are Examples according to the present invention)

*1AES: Sodium alkyl ether sulfate having 12-14 carbon atoms and an average ethylenoxide addition mol number ($EO_{\bar{p}}$) of 3 mol

*2AOS: Sodium α-olefin sulfonate having 14 carbon atoms

*3LAS: Sodium linear alkylbenzene sulfonate having 12-14 carbon atoms

*4ACL: Polyoxyethylene alkyl ether ($\bar{p}$ = 12) having 13 carbon atoms

*5

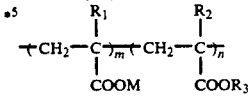

DEA: Diethanolamine

MEA: Monoethanolamine

TEA: Triethanolamine

EXAMPLE 2

The liquid detergent compositions having the compositions shown below were prepared, and the storage stabilities at 25° C. and 45° C. thereof were evaluated. The results are shown in Table 2.

| Components | Formulated amount |
|---|---|
| Anionic surfactant (kinds and formulated amounts listed in Table 2) | 17–22 wt. % |
| Copolymer (kinds and formulated amounts listed in Table 2) | 0.5–1.3 wt. % |
| Zeolite (formulated amounts listed in Table 2) | 8–18 wt. % |
| Diethanolamine | 10 wt. % |
| p-Toluenesulfonic acid | 2 wt. % |
| Fluorescent agent | 0.17 wt. % |
| Polyethylene glycol (average molecular weight 1000) | 1 wt. % |
| Enzyme | 0.5 wt. % |
| Perfume | 0.2 wt. % |
| Water | Balance |

TABLE 2

Liquid detergent composition $$\left(CH_2-\underset{\underset{COOM}{|}}{\overset{\overset{R_1}{|}}{C}}\right)_l \cdot \left(CH_2-\underset{\underset{COOR_4}{|}}{\overset{\overset{R_2}{|}}{C}}\right)_m \cdot \left(CH_2-\underset{\underset{COOR_5}{|}}{\overset{\overset{R_3}{|}}{C}}\right)_n$$

| No.*1 | Surfactant Kind*2 | Surfactant Amount (%)*3 | $R_1$ | $R_2$ | $R_3$ | $R_4$ | $R_5$ | M | l/m/n | l/m | n/(l + m + n) | Amount (%) | Zeolite Amount (%) | Evaluation Storage stability 25° C. | Evaluation Storage stability 45° C. |
|---|---|---|---|---|---|---|---|---|---|---|---|---|---|---|---|
| 1 | AES/AOS | 10/10 | No addition of copolymer | | | | | | | | | | 15 | – | – |
| 2 | AES/AOS | 10/10 | Methyl | Hydrogen | Hydrogen | Ethyl | Cyclohexyl | Na | 32/64/4 | 1/2 | 4/100 | 1.0 | 15 | ++ | + |
| 3 | AES/AOS | 10/10 | " | " | " | " | Stearyl | Na | 32/64/4 | 1/2 | 4/100 | 1.0 | 15 | ++ | ++ |
| 4 | AES/AOS | 10/10 | " | " | " | " | 2-Ethylhexyl | Na | 32/64/4 | 1/2 | 4/100 | 1.0 | 15 | ++ | ++ |
| 5 | AES/AOS | 10/10 | " | " | " | " | Lauryl | Na | 32/64/4 | 1/2 | 4/100 | 1.0 | 15 | ++ | ++ |
| 6 | AES/AOS | 10/10 | " | " | " | " | i-Butyl | Na | 32/64/4 | 1/2 | 4/100 | 1.0 | 15 | ++ | ++ |
| 7 | AES/AOS | 10/10 | " | " | " | " | n-Butyl | Na | 32/64/4 | 1/2 | 4/100 | 1.0 | 15 | ++ | ++ |
| 8 | AES/AOS | 10/10 | " | " | " | " | " | Na | 30/60/10 | 1/2 | 10/100 | 1.0 | 15 | ++ | ++ |
| 9 | AES/AOS | 10/10 | " | " | " | " | " | Na | 28/56/16 | 1/2 | 16/100 | 1.0 | 15 | ++ | ++ |
| 10 | AES/AOS | 10/10 | " | " | " | " | " | Na | 24/48/28 | 1/2 | 23/100 | 1.0 | 15 | ++ | ++ |
| 11 | PS/AES | 17/5 | Hydrogen | Methyl | Methyl | " | Cyclohexyl | Na | 42/21/37 | 2/1 | 37/100 | 0.5 | 8 | ++ | ++ |
| 12 | PS/AES | 17/5 | " | " | Hydrogen | " | Stearyl | Na | 42/21/37 | 2/1 | 37/100 | 0.75 | 8 | ++ | ++ |
| 13 | PS/AES | 17/5 | " | " | " | " | 2-Ethylhexyl | Na | 42/21/37 | 2/1 | 37/100 | 0.75 | 12 | ++ | ++ |
| 14 | PS/AES | 17/5 | " | " | " | " | Lauryl | Na | 42/21/37 | 2/1 | 37/100 | 0.75 | 12 | ++ | ++ |
| 15 | PS/AES | 17/5 | " | " | " | " | i-Butyl | Na | 42/21/37 | 2/1 | 37/100 | 0.75 | 12 | ++ | + |
| 16 | PS/AES | 17/5 | " | " | " | " | n-Butyl | Na | 42/21/37 | 2/1 | 37/100 | 0.75 | 12 | ++ | ++ |
| 17 | LAS/ACG | 10/7 | Methyl | Hydrogen | " | Methyl | Lauryl | Na | 30/60/10 | 1/2 | 10/100 | 1.3 | 18 | + | + |
| 18 | LAS/ACG | 10/7 | " | " | " | " | i-Butyl | Na | 30/60/10 | 1/2 | 10/100 | 1.3 | 18 | + | + |
| 19 | LAS/ACG | 10/7 | " | " | " | " | n-Butyl | Na | 30/60/10 | 1/2 | 10/100 | 1.3 | 18 | + | + |

*1No. 1 is a Comparative Example and the others are Examples.
*2AES: Na alkylether sulfate ($C_{13}$, $\bar{p}$ = 3), AOS: Na α-olefinsulfonate ($C_{14}$–$C_{18}$), PS: Na p-sulfonate ($C_{14}$–$C_{18}$), LAS: linear Na alkylbenzenesulfonate ($C_{12}$), ACG: polyoxyethylene alkyl ether ($C_{13}$, $\bar{p}$ = 7)
*3For example, No. 14 means formulation of 17 wt. % of PS, 5 wt. % of AES in the liquid detergent composition

EXAMPLE 3

Using a four-component copolymer in the form of a methacrylic acid/ethyl acrylate/n-butyl acrylate skeleton with which a further acrylamide is copolymerized, a detergent composition having the composition shown below was prepared, and the storage stability at 45° C. thereof was evaluated. As a result, the evaluation was found to be ++ (5 vol. % or less separation ratio at upper layer).

| Components | Formulated amount |
|---|---|
| AES | 10 wt. % |
| AOS | 10 wt. % |
| Copolymer*1 | 1 wt. % |
| Zeolite | 15 wt. % |
| Diethanolamine | 10 wt. % |
| p-Toluenesulfonic acid | 2 wt. % |
| Fluorescent agent | 0.17 wt. % |
| Polyethylene glycol (average molecular weight 1000) | 1 wt. % |
| Enzyme | 0.5 wt. % |
| Perfume | 0.2 wt. % |
| Water | Balance |

*1

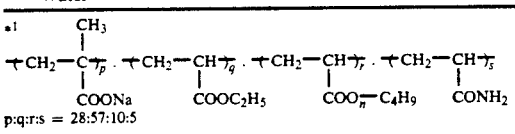

p:q:r:s = 28:57:10:5

EXAMPLE 4

The liquid detergent compositions having compositions shown in Table 3 were prepared and evaluated. The results are shown in Table 3.

EXAMPLE 5

The liquid detergent compositions having compositions shown in Table 4 were prepared and evaluated. The results are shown in Table 4.

TABLE 3

| | Sample No. | | | | | | | | | | | | | | |
|---|---|---|---|---|---|---|---|---|---|---|---|---|---|---|---|
| | 1 | 2 | 3* | 4* | 5* | 6* | 7* | 8* | 9* | 10 | 11 | 12 | 13 | 14 | 15 |
| Composition wt % | | | | | | | | | | | | | | | |
| (a) AES*1 | 10 | 7.5 | 7.5 | 10 | 10 | 2.5 | 5 | 5 | 7.5 | 10 | 10 | — | 10 | 10 | 10 |
| AOS*2 | 10 | 7.5 | 7.5 | 10 | 10 | 2.5 | 5 | 5 | 7.5 | 10 | 10 | 10 | 10 | 10 | 10 |
| ACS ($\bar{p}$ = 12)*3 | — | — | — | — | — | — | — | — | — | — | — | 10 | — | — | — |
| (b) Zeolite | 15 | 10 | 7 | 15 | 3 | 20 | 25 | 33 | 10 | 15 | 15 | 15 | 15 | 15 | 15 |
| (c) Diethanolamine | 10 | 7 | 6 | 3 | 15 | 15 | 10 | 10 | 15 | — | — | 10 | 10 | 10 | 10 |
| Monoethanolamine | — | — | — | — | — | — | — | — | — | 10 | — | — | — | — | — |
| Triethanolamine | — | — | — | — | — | — | — | — | — | — | 15 | — | — | — | — |
| (d) Copolymer*4 | | | | | | | | | | | | | | | |
| I | 1 | 3 | 2 | 1 | 1 | 1 | 0.3 | 0.8 | 6 | 1 | 1 | 1 | — | — | — |
| II | — | — | — | — | — | — | — | — | — | — | — | — | 1 | — | — |
| III | — | — | — | — | — | — | — | — | — | — | — | — | — | 1 | — |
| IV | — | — | — | — | — | — | — | — | — | — | — | — | — | — | 1 |
| Enzyme | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |
| Propylene glycol | 3 | 3 | 3 | 3 | 3 | 3 | 3 | 3 | 3 | 3 | 3 | 3 | 3 | 3 | 3 |
| Water | Balance | | | | | | | | | | | | | | |
| (a) + (b) + (c) (wt %) | 45 | 32 | 28 | 38 | 38 | 40 | 45 | 53 | 40 | 45 | 50 | 45 | 45 | 45 | 45 |
| Detergency power*5 | 80 | 70 | 55 | 60 | 58 | 55 | — | — | — | 82 | 80 | 80 | 80 | 80 | 80 |
| Viscosity (25° C.) | 23 | 35 | 23 | 20 | 6 | 23 | 30 | 60 | 80 | 23 | 25 | 25 | 20 | 23 | 25 |
| Storage stability | + | + | + | + | + | + | − | + | + | + | + | + | + | + | + |

*) Sample Nos. 3–9 are Comparative Examples and the others are Examples.

*1) AES: Sodium alkylether sulfate having $C_{12-14}$ alkyl and average addition mole of EO ($EO_p$) of 3 mole.

*2) AOS: Sodium β-olefin sulfonate having 14–18 carbon atoms.

*3) ACG($\bar{p}$=12): Polyoxyethylene alkyl ether having 13 carbon atoms.

*4) I: Methacrylic acid/ethyl acrylate (3/7) copolymer having weight average molecular weight ($\overline{Mw}$) of $70\times10^4$ II: Acrylic acid/propyl methacrylate (3/7) copolymer having $\overline{Mw}$ of $30\times10^4$ III: Methacrylic acid/methyl methacrylate (4/6) copolymer having $\overline{Mw}$ of $50\times10^4$ IV: Methacrylic acid/butyl acrylate (5/5) copolymer having $\overline{Mw}$ of $70\times10^4$

*5 Evaluation of Detergency Power (i) Preparation of artificial soils

Clays containing, as main components, crystalline minerals such as kaolinite and vermiculite were dried at 200° C. for 30 hours and used as an inorganic soil.

A 3.5 g amount of gelatin was dissolved in 950 cc of water at about 40° C., followed by dispersing 0.25 g of carbon black in water, using a strong emulsifying disperser, polytron (manufactured by KINEMATICA, Switzerland). Thereafter, 14.9 g of the inorganic soils were added thereto and emulsified by Polytron, and 31.35 g of organic soils were added thereto followed by emulsifying by a Polytron, to thereby prepare a stable soil bath. After clean fabrics (cotton fabric #60 designated by Nippon Yukagaku Kyokai) each having a size of 10 cm×20 cm were dipped in the above-mentioned soil bath, the water was squeezed by two rubber rolls, whereby the amount of the soils adhered was made uniform. After the soiled fabrics were dried at 105° C. for 30 minutes, both surfaces of the soiled fabrics were rubbed 25 times each at the left and right sides. The fabric were then cut to those having a size of 5 cm×5 cm, and those having a reflectance of 42±2% were used as soiled fabric samples.

The composition of the soil adhered to the artificial soiled fabric thus obtained was as follows.

| Soil Component | Composition (%) |
|---|---|
| Organic soil | |
| Oleic acid | 28.3 |
| Triolein | 15.6 |
| Cholesterol oleate | 12.2 |
| Fluid paraffin | 2.5 |
| Squalane | 2.5 |
| Cholesterol | 1.6 |
| (total of oily soils) | (62.7) |
| Gelatin | 7.0 |
| Inorganic soil | 29.8 |
| Carbon black (designated by Nippon Yukagaku Kyokai) | 0.5 |

(ii) Washing method

A total amount of sample fabrics was made 30 g by adding charge fabrics to 10 sheets of the artificial soiled fabrics, and the sample fabrics were washed for 10 minutes in a Terg-O-To-Meter using40 ml/30l of a detergent under the conditions of 25° C. and 3°DH, followed by rinsing twice. The reluctances of the soiled fabrics and the washed fabrics were measured, and the detergency power was determined by the following equation.

$$\text{Detergency power (\%)} = \frac{(K/S \text{ soiled fabric}) - (K/S \text{ of washed fabric})}{(K/S \text{ of soiled fabric}) - (K/S \text{ of unsoiled fabric})} \times 100$$

$$K/S = \left(1 - \frac{R}{100}\right)^2 / \frac{2R}{100} \text{ (Kubelka Munk's equation)}$$

*R:* reflectance (%) measured by an ELREPHO reflectometer (manufactured by Carl Zeiss, Switzerland).

The evaluation of the detergency power was made based upon an average of 10 artificially soiled fabric samples, and those of 65% or more were evaluated as "good".

TABLE 4

| | Sample No. | | | | | | | | | | | | |
|---|---|---|---|---|---|---|---|---|---|---|---|---|---|
| | 21* | 22 | 23 | 24* | 25* | 26* | 27* | 28* | 29* | 30 | 31 | 32 | 33 |
| Composition wt. % | | | | | | | | | | | | | |
| (a) AES*1 | 10 | 10 | 10 | 10 | 10 | 10 | 10 | 10 | — | — | 10 | 10 | 10 |
| AOS*2 | 10 | 10 | 10 | 10 | 10 | 10 | 10 | 10 | 10 | 10 | 10 | 10 | 10 |
| ACG (p = 12)*3 | — | — | — | — | — | — | — | — | 10 | 10 | — | — | — |
| (b) Zeolite | 15 | 15 | 15 | 15 | 15 | 15 | 15 | 15 | 15 | 15 | 15 | 15 | 15 |
| (c) Diethanolamine | 10 | 10 | 10 | 10 | 10 | 10 | 10 | 10 | 10 | 10 | 10 | 10 | 10 |
| (d) Copolymer*4 | | | | | | | | | | | | | |
| I | 1 | 1 | 1 | 1 | 1 | 1 | 1 | 0.3 | 1 | 1 | — | — | — |
| II | — | — | — | — | — | — | — | — | — | — | 1 | — | — |
| III | — | — | — | — | — | — | — | — | — | — | — | 1 | — |
| IV | — | — | — | — | — | — | — | — | — | — | — | — | 1 |
| (e) p-Toluene sulfonic acid | — | 1 | 3 | — | — | — | — | — | — | 1 | 1 | 1 | 1 |
| Propylene glycol | — | — | — | 5 | — | — | — | — | — | — | — | — | — |
| Ethanol | — | — | — | — | 5 | — | — | — | — | — | — | — | — |
| Polyethylene glycol (Mw = 1000) | — | — | — | — | — | 5 | — | — | — | — | — | — | — |
| Ethylene glycol | — | — | — | — | — | — | 5 | — | — | — | — | — | — |
| Water | | | | | | Balance | | | | | | | |
| (a) + (b) + (c) (wt %) | 45 | 45 | 45 | 45 | 45 | 45 | 45 | 45 | 45 | 45 | 45 | 45 | 45 |
| Viscosity (25° C.) | 23 | 15 | 10 | 23 | 23 | 23 | 23 | 10 | 25 | 15 | 13 | 15 | 17 |
| Storage stability | + | + | + | + | + | + | + | − | + | + | + | + | + |

*Sample Nos. 21, 24–29 are Comparative Examples and the others are Examples.
*1AES: Sodium alkylether sulfate having $C_{12-14}$ alkyl and average addition mole of EO ($EO_{\bar{p}}$) of 3 mole.
*2AOS: Sodium α-olefin sulfonate having 14–18 carbon atoms.
*3ACG (p = 12): Polyoxyethylene alkyl ether having 13 carbon atoms.

*4)I: Methacrylic acid/ethyl acrylate (3/7) copolymer having weight average molecular weight ($\overline{Mw}$) of $70 \times 10^4$ II: Acrylic acid/propyl methacrylate (3/7) copolymer having $\overline{Mw}$ of $30 \times 10^4$ III: Methacrylic acid/methyl methacrylate (4/6) copolymer having $\overline{Mw}$ of $50 \times 10^4$ IV: Methacrylic acid/butyl acrylate (5/5) copolymer having $\overline{Mw}$ of $70 \times 10^4$

We claim:

1. A liquid detergent composition comprising:
(a) 5 to 50% by weight of a surfactant;
(b) 1 to 30% by weight of a zeolite; and
(c) 0.1 to 5% by weight or a copolymer consisting of essentially of the copolymerized components having the formulae (III), (IV), and (V):

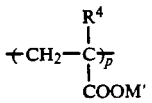

(III)

-continued

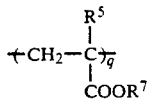

(IV)

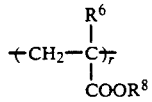

(V)

wherein
$R^4$ represents hydrogen or methyl,
$R^5$ represents hydrogen or methyl,
$R^6$ represents hydrogen or methyl,
$R^7$ represents methyl or ethyl,
$R^8$ represents an alkyl or alkenyl having 3 to 24 carbon atoms,
M' represents hydrogen or a counter ion,
p/q is 2/8 to 8/2 (mol ratio) and $r/(p+q+r) = 1/50$ to 20/50 (mol ratio); and
a balance of water 2. A liquid detergent composition as claimed in claim 1 further comprising (d) 5 to 20% by weight of an alkanolamine.

3. A liquid detergent composition as claimed in claim 2 further (e) comprising 0.8% by weight or more of p-toluene sulfonic acid or its salt.

4. A liquid detergent composition as claimed in claim 1, wherein the surfactant is at least one anionic surfactant.

5. A liquid detergent composition as claimed in claim 1, wherein said zeolite has the following formula (VI):

$$x(M''_2O \text{ or } M'''O).Al_2O_3.y(SiO_2).z(H_2O) \quad \text{(VI)}$$

wherein M'' represents an alkali metal atom, M''' represents an alkaline earth metal atom exchangeable with calcium, and x, y, and z are a mole number of each component.

* * * * *